US006094743A

United States Patent [19]

Delgado

[11] Patent Number: 6,094,743

[45] Date of Patent: Aug. 1, 2000

[54] DEFLECTOR-ARM PROTECTOR

[76] Inventor: Steve R. Delgado, 16646 La Avenida, Houston, Tex. 77062

[21] Appl. No.: 09/042,383

[22] Filed: Mar. 13, 1998

Related U.S. Application Data

[60] Provisional application No. 60/040,974, Mar. 14, 1997.

[51] Int. Cl.[7] ..... A41D 13/08

[52] U.S. Cl. ..... 2/16; 2/22

[58] Field of Search ..... 2/16, 22, 455, 2/456, 459, 461, 125, 20

[56] References Cited

U.S. PATENT DOCUMENTS

| | | | |
|---|---|---|---|
| 1,253,260 | 1/1918 | Levinson | 2/455 |
| 1,627,382 | 5/1927 | Golomb | 2/16 |
| 4,512,037 | 4/1985 | Vacanti | 2/455 |
| 4,556,992 | 12/1985 | Drury | 2/20 |
| 4,756,026 | 7/1988 | Pierce, Jr. | 2/16 |
| 5,065,457 | 11/1991 | Henson | 2/16 |
| 5,594,954 | 1/1997 | Huang | 2/24 |

*Primary Examiner*—Diana Oleksa
*Assistant Examiner*—Katherine Moran
*Attorney, Agent, or Firm*—Michael B. Jolly

[57] ABSTRACT

Deflector - Arm Protector provides protection to athletes participating in sports such as but not limited to baseball or softball. This arm protector wraps around the entire arm from the hand to the shoulder and is secured by velcro straps. This concept can be adapted to protect any vulnerable portion of the human body. It is comprised of padded material covered by a flexible plastic insert with varying geometric profiles fitted within a sleeve of elastic cloth type material of varying shapes depended on the required protective coverage for the arm. The impact force on the athlete's arm is greatly reduced due to the design profile (insert/pad assembly) load distribution, thus making it less painful when hit by the pitched baseball or softball.

7 Claims, 6 Drawing Sheets

DEFLECTOR-ARM PROTECTOR

This application claims benefit of provisional application 60/040984, filed Mar. 14, 1997.

BACKGROUND OF THE INVENTION

1. Field of the Invention

This invention is directed towards protection for athletic activities and improving preventative methods for injury.

2. Description of Related Art

A variety of sports equipment provide the necessary protection requires for athletic participation in activities involving impact forces. It is desirable to minimize the magnitude of force inflicted upon various areas of the athlete's body. Athletes at all levels of competition (e.g. ranging from Little Leagues to the Major Leagues) continue to play at various levels of risk which potentially leads towards injury.

The present inventor has recognized a need for improved protection and freedom for movement (e.g. not limited to baseball or softball) which continues to allow body mechanics to proceed without any intervention. Today's market provides protection for the hand, forearm, elbow, or any combination thereof. This protective gear usually is comprised of various padded material or combined with a plastic insert to help reduce the impact force generated.

Prior art pad material configurations (e.g. U.S. Pat. Nos. 4,951,317 and 3,991,420) provide some protection but tends to be bulky and inconvenient for wear. Some designs prohibit freedom of movement because they are bulky and rigid. Most configurations provide pad material or enhanced with plastic inserts to minimize the load due to impact forces (e.g. U.S. Pat. Nos. 4,756,026; D290,766; D300,676; and D311,075).

SUMMARY OF THE INVENTION

Improvement on protection and impact force distribution are achieved by the deflector concept used by athletes participating in a variety of sports activities. This protective garment wraps around the entire arm from the hand to the shoulder and is secured by VELCRO™ straps. This embodiment can have single or multiple connectors (VELCRO™) depended on the coverage for protection. Protection can be adapted for any joint whether it be a knee, hip, wrist, ankle, shoulder or any combination thereof. A flexible plastic insert interfaced with padding material both with varying geometry absorbs impact forces (e.g. pitched softball or baseball). The impact on the arm are greatly reduced to the load distribution stemming from the design profile.

The Deflector is comprised of padded material (e.g. foam, cotton material, rubber sponge, etc.) covered by a flexible plastic insert with varying geometric profiles for absorbing and distributing impact forces. Both the padding and plastic inserts are fitted within a sleeve of varying shapes depended on the requires protective coverage for the arm. The allowable freedom for body mechanics is consider to be an additional benefit.

This Invention has a unique cross section consisting of plastic insert/padding assembly. Consider the plastic insert as the primary layer and the padding as the secondary layer for protection. The spacing between the hemispherical profiles or mounds (on plastic insert) is designed to accommodate and distribute impact forces coming from baseball and softball geometry's. The mounds can be created as solid profiles of varying thickness or may even include holes as an option for additional air circulation. Flexibility comes from the small triangular or radial grooves with minimal thickness located between the mounds of the plastic layer. The secondary protective layer (padding) provides the cushion between the plastic insert and the body and continues to minimize the impact forces. Holes in the padding itself are considered an option for additional air circulation.

BRIEF DESCRIPTION OF THE DRAWINGS

Embodiments of the invention summarized above may be better understood by referring to the following descriptions along with the respective drawings.

DESCRIPTION OF THE PREFERRED EMBODIMENT

Figures 1, 2:
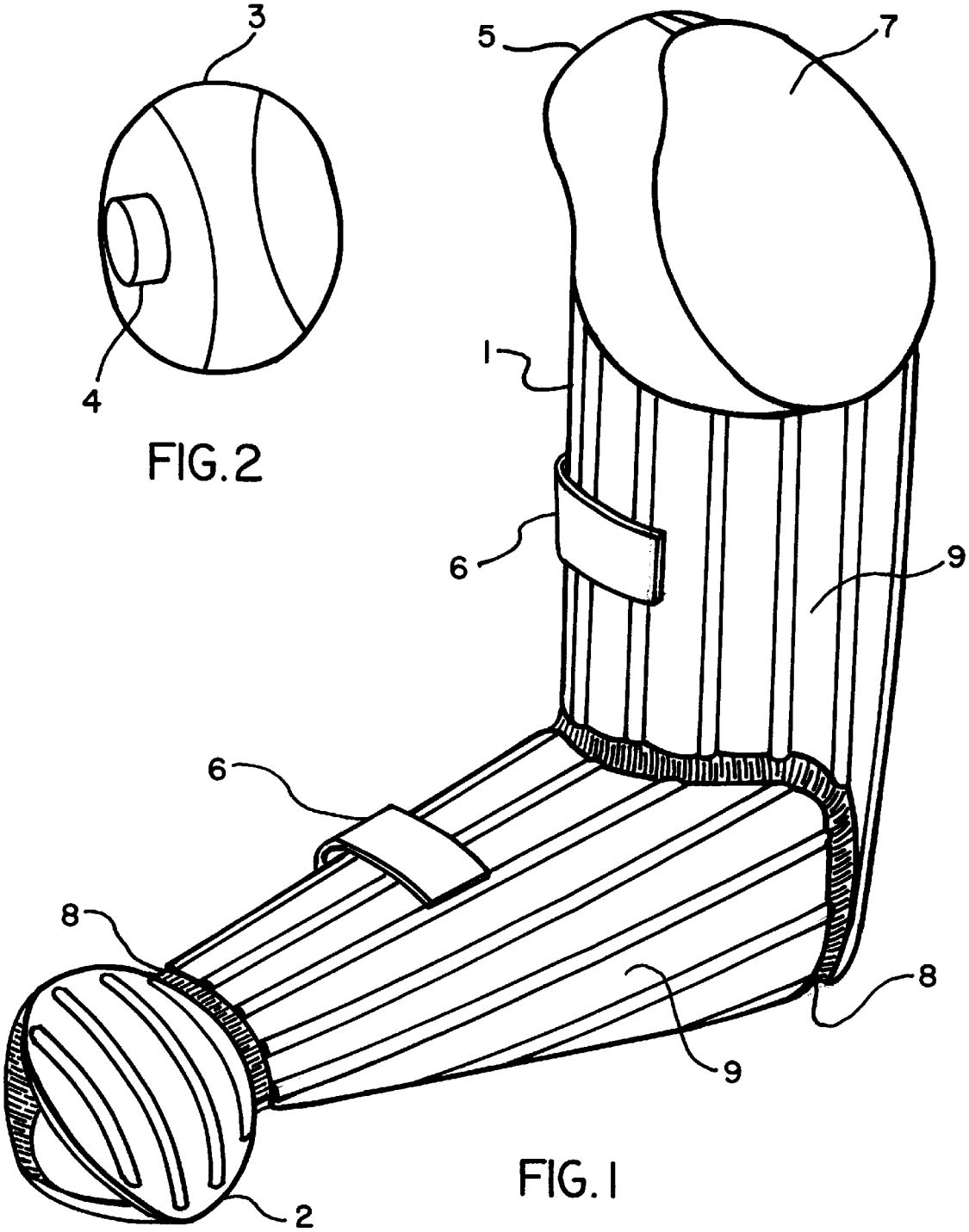
FIG. 1 shows the "Deflector" - Arm Protector general concept
FIG. 2 shows the backside of the hand protection

This arm protector, FIG. 1, wraps around the entire arm from the hand to the shoulder. The arm protector is designed for quick assembly by inserting the hand and arm through an opening, A in FIG. 1, between the elbow and shoulder. The hand is fitted between the hand protector, B in FIG. 1, and elastic band, C in FIG. 2. Inserting two to three middle fingers into the elastic band, D in FIG. 2, helps to secure the hand protector.

The shoulder pad assembly, G in FIG. 1, has a VELCRO™ strap underneath, E. in FIG. 1, which is assembled onto a mating piece sewn onto the athlete's jersey or uniform. The entire arm protector assembly is fitted snugly by securing the VELCRO™ straps, F in FIG. 1, according to the Athlete's comfort needs.

The hand protector, B in FIG. 1, and flexible plastic insert/pad assembly, I in FIG. 1, located between hand and elbow and also located between elbow and shoulder are tied by an elastic band or cloth type material, H in FIG. 1.

The entire arm protector, FIG. 1, is enclosed within a sleeve of varying shapes depended on the required protective coverage for the arm. The sleeve can be made of any elastic type material such as nylon, polyester, rayon, cotton, or material combinations.

Figure 3:
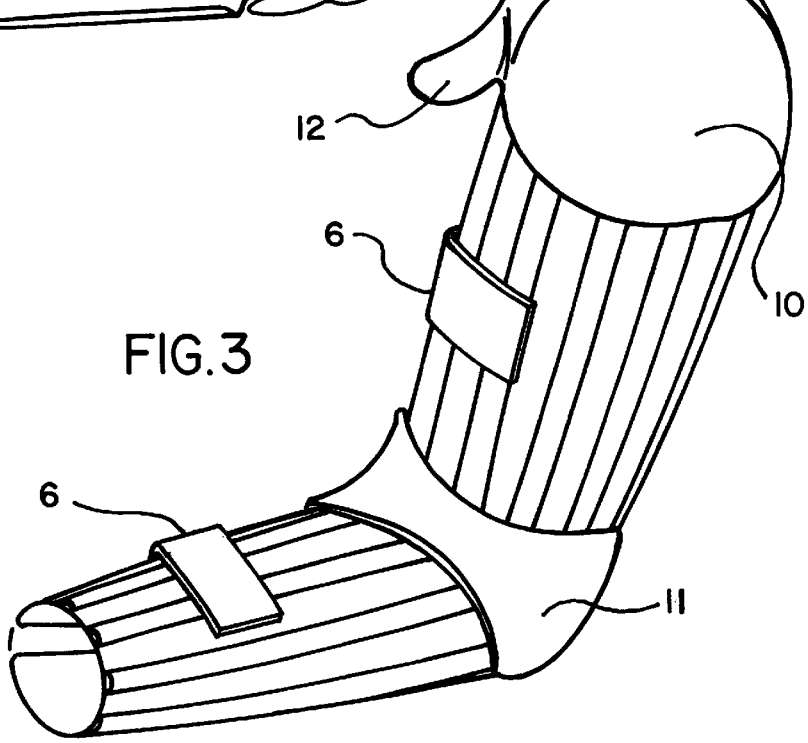
FIG. 3 shows the "Deflector" with alternate shoulder and elbow profile

An alternative arm protector, FIG. 3, shown without the hand protector, B in FIG. 1, exhibits a new shoulder assembly, J in FIG. 3, and new elbow assembly, K in FIG. 3. The new shoulder pad assembly also has a VELCRO™ strap, E in FIG. 3, adhered underneath to latch onto a sewn strap found on the uniform. A secondary VELCRO™ strap, L in FIG. 3, found underneath an extended material segment will provide additional retention. The VELCRO™ straps, F in FIG. 3, continue to provide the primary retainment of the arm protector.

Figure 4:
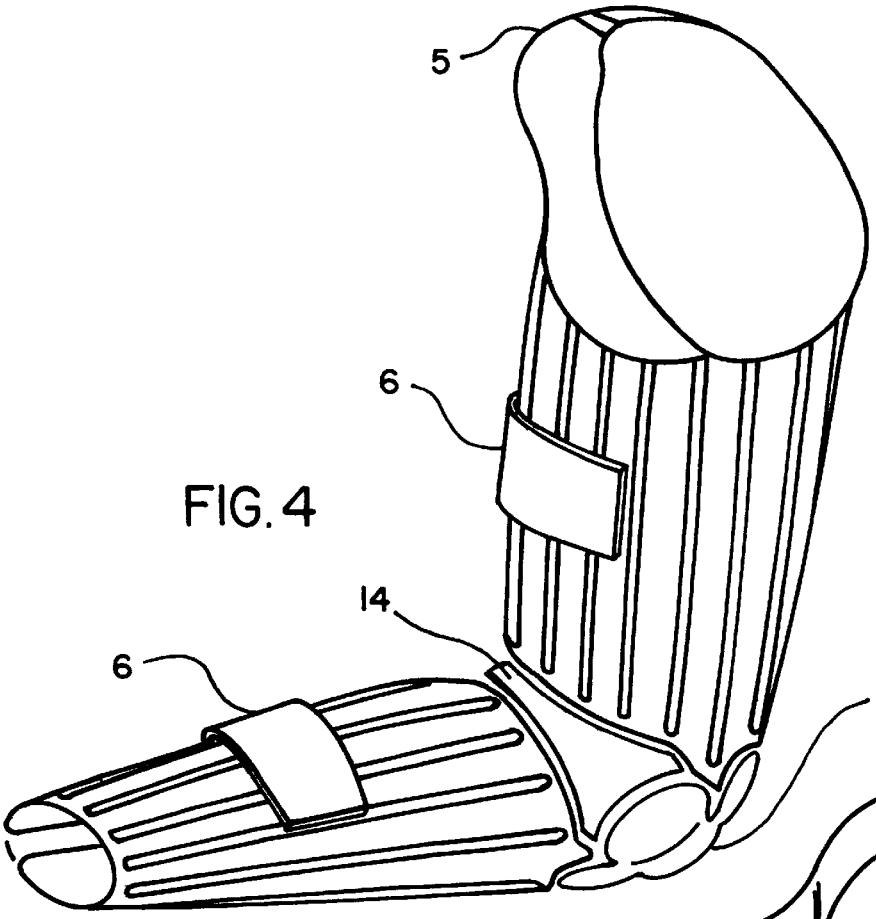
FIG. 4 shows the "Deflector" with alternate elbow profile

A third alternative arm protector, FIG. 4, has no protection for the hand, B in FIG. 1, yet exhibits an alternate elbow assembly, M in FIG. 4. A single piece (flexible plastic insert/pad geometry), N in FIG. 4, provides protection above the elbow. Otherwise, the primary adjustment and latching for the arm protector come from the straps, F in FIG. 4, and the shoulder strap, E in FIG. 4, previously described in FIG. 1 and FIG. 2.

Figure 6:
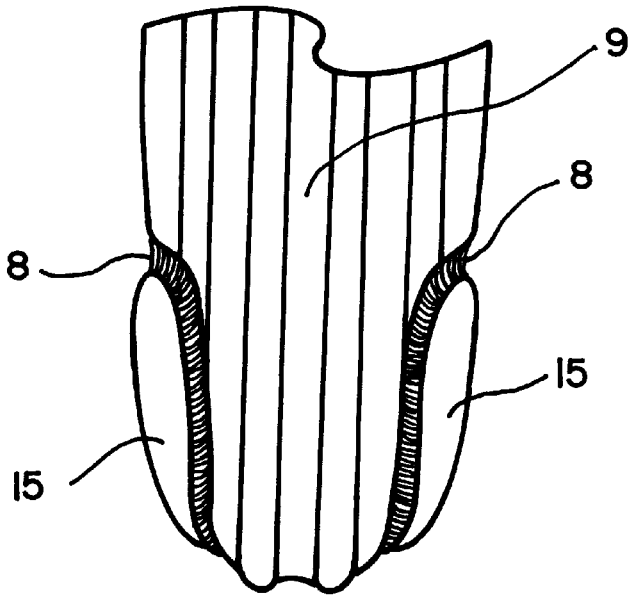
FIG. 6 shows end view of elbow area of arm protector

A rear end view, FIG. 6, of the arm exhibits the flexible plastic insert/pad assembly, I in FIG. 6, extending down the arm with a predetermined width over the elbow extending down the forearm for a predetermined length. Portions of the arm protector covering the forearm, 0 in FIG. 6, are attached to the elbow and upper arm segment by an elastic band or cloth type material, H in FIG. 6.

Figure 5:
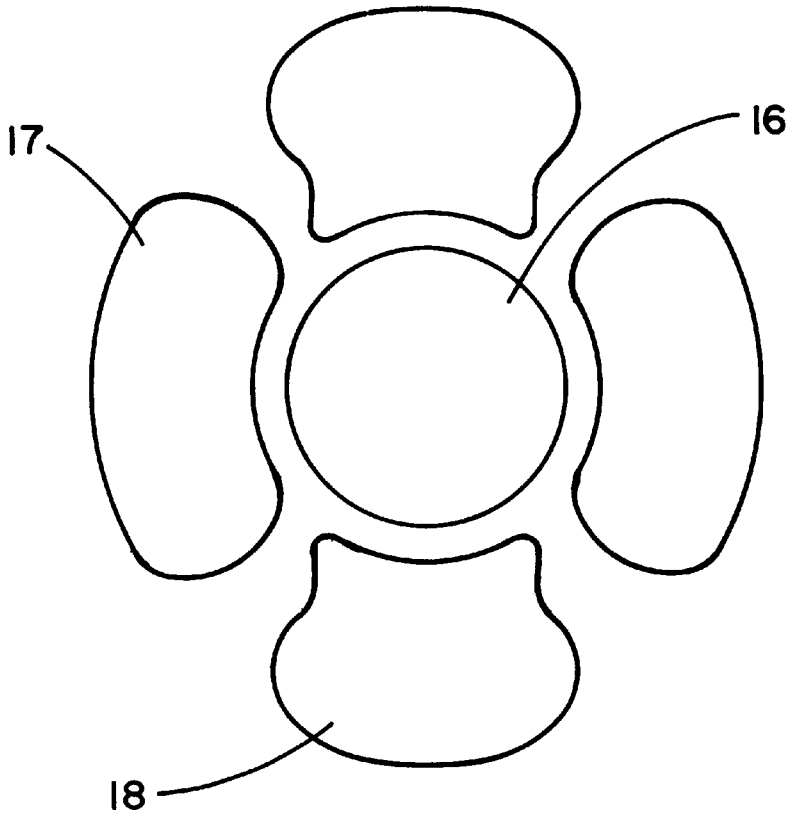
FIG. 5 shows view of alternate elbow protection for arm protector

An alterative concept for elbow protection, FIG. 5 and M in FIG. 4, exhibits an insert/pad configuration illustrating the center pad, P in FIG. 5, as the pivotal protection. The remaining insert/pad assemblies, Q and R in FIG. 5, provide the extended protection required for the adjacent sides of the elbow pivotal point.

Figure 8:
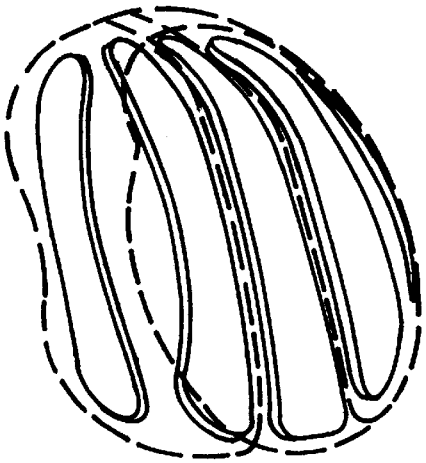
FIG. 8 shows the alternate padding layout for the shoulder
Figure 7:
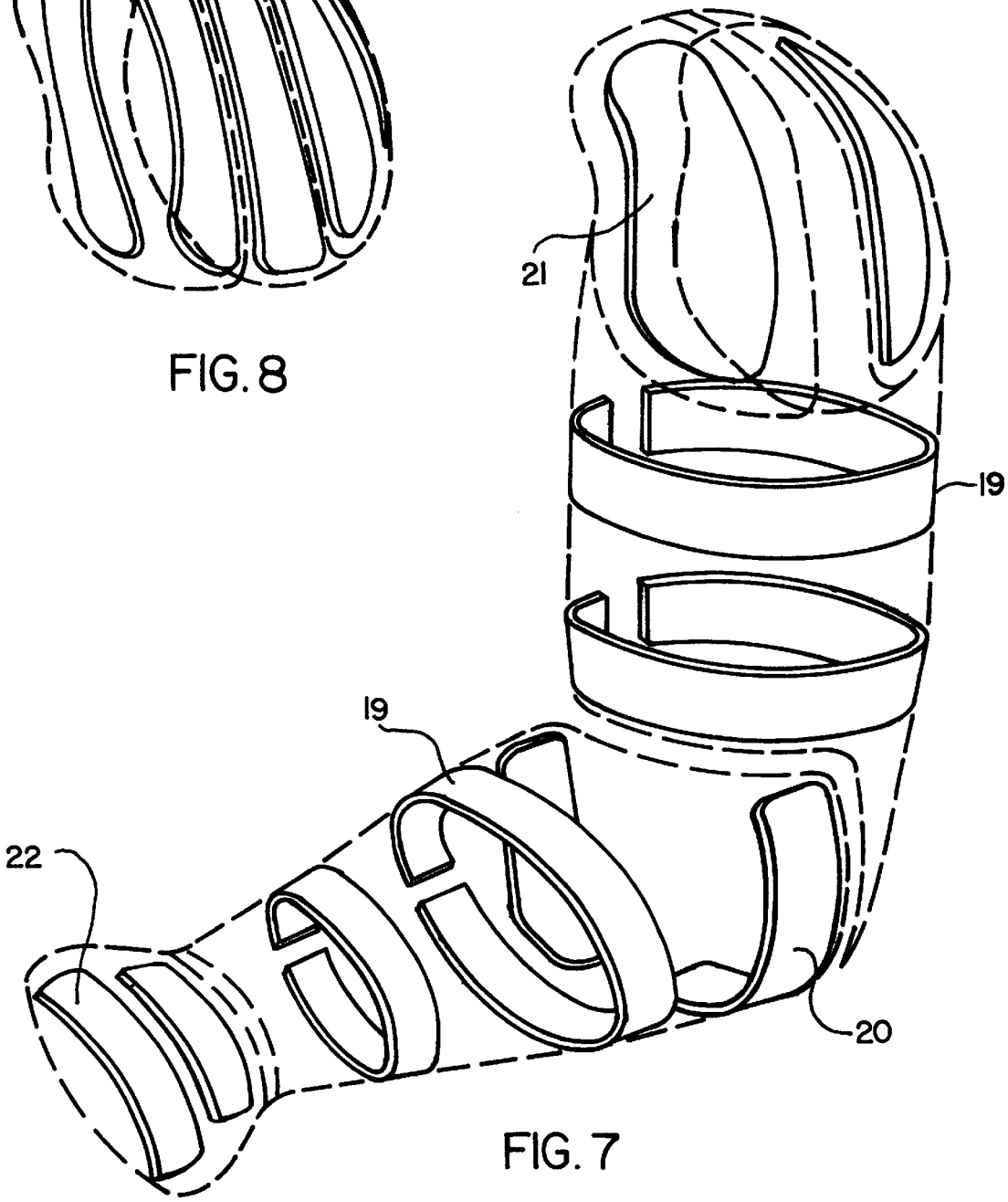
FIG. 7 shows the padding layout for the arm protector

The secondary protective layer (padding) as illustrated in FIG. 7 can provide backup coverage to the flexible plastic insert for the entire area or as pad configurations, S in FIG. 7. Elbow pad coverage requires a different geometry, T in FIG. 7. The hand requires a couple of pads, V in FIG. 7, to support the insert. Coverage for the shoulder, also requires geometry's, U in FIG. 7, conforming to the pad for the sheath pad assembly. Another alternative pad assembly for the shoulder is illustrated in FIG. 8.

Figure 10:
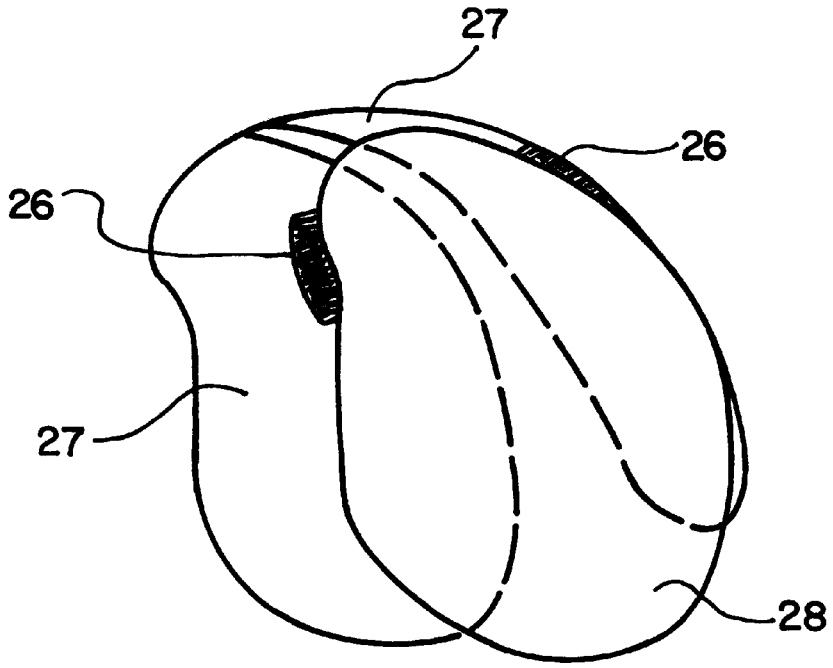
FIG. 10 shows a view of sheathe shoulder pads
Figure 9:
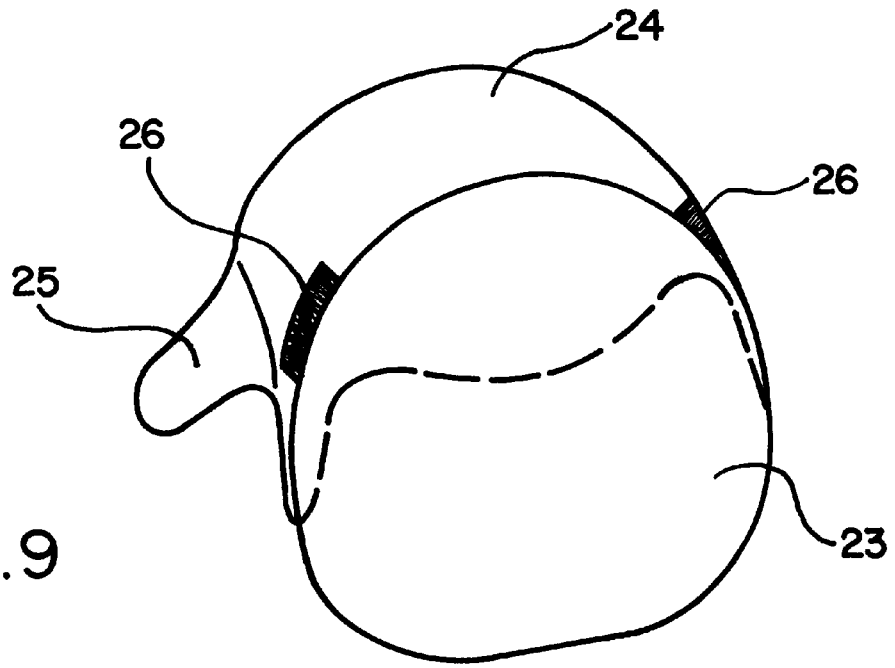
FIG. 9 shows a view of alternate shoulder pads

Two concepts for shoulder protection are illustrated in FIG. 9 and FIG. 10. These profiles are contained within a sleeve fabricated from an elastic cloth type material. One shoulder profile, FIG. 9, exhibits a pad/plastic shell, X in FIG. 9, held together by sewn or adhered elastic bands, Z in FIG. 9, on either side of adjoining pad/plastic shell, W in FIG. 9. An extension, Y in FIG. 9, provides another location for VELCRO™ latching. Another shoulder profile, FIG. 10, exhibits a sheath pad profile that enables the pad/plastic shells, 1 in FIG. 10, to expand away from one another using plastic bands found underneath the single pad/plastic shell, 2 in FIG. 10, as the arm is reaching up away from the body. This single pad, 2 in FIG. 10, is attached to the other two pads, 1 in FIG. 10, with sewn or adhered elastic bands, Z in FIG. 10.

Figure 13:
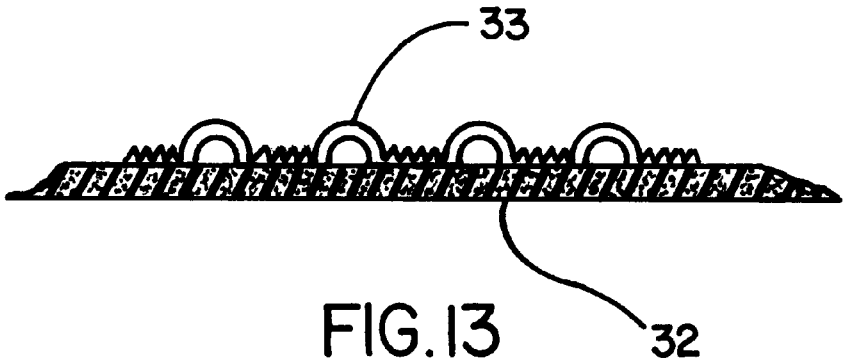
FIG. 13 shows the end view of the flexible plastic insert
Figure 12:
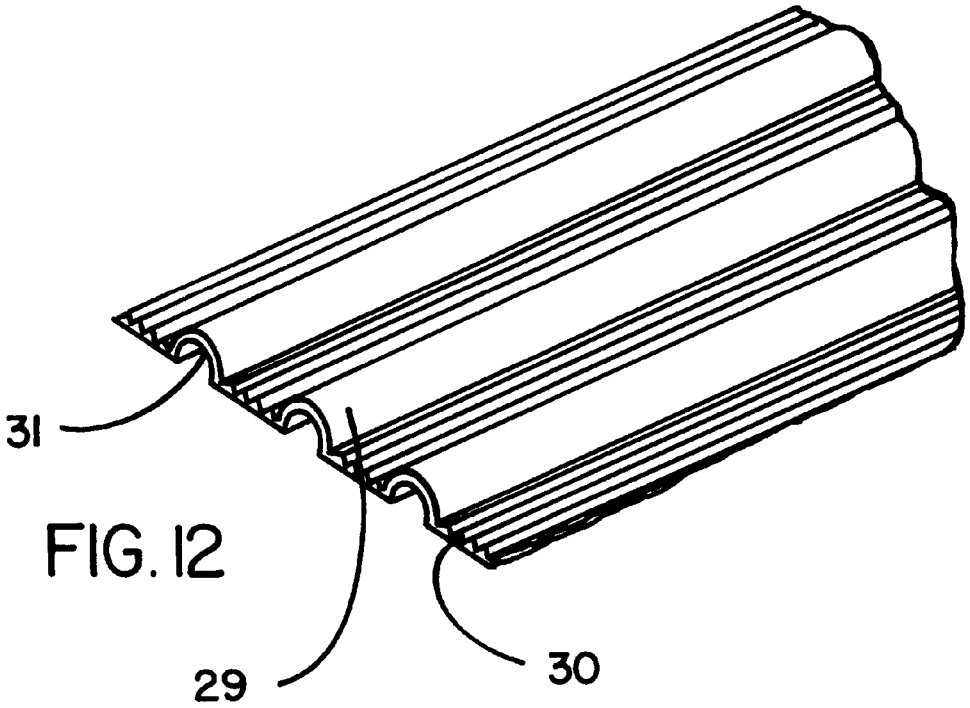
FIG. 12 shows the isometric view of the plastic insert with hemispherical profiles or mounds separated by triangular or radial grooves for flexibility
Figure 11:
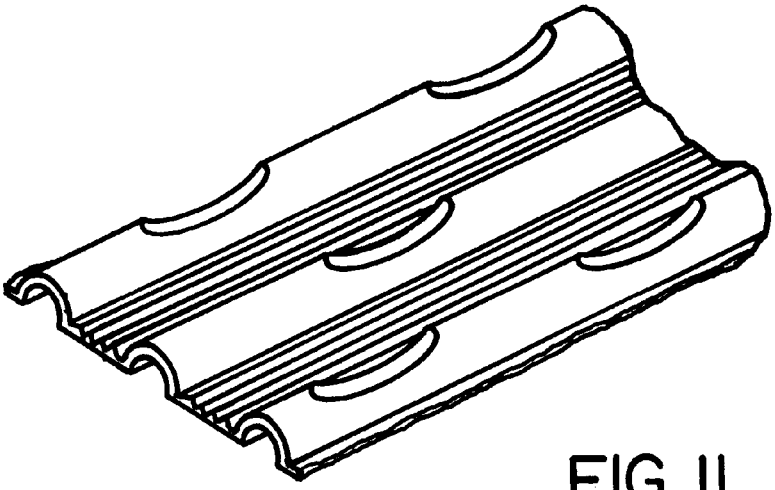
FIG. 11 shows the isometric view of the plastic insert with holes as an option

Two flexible plastic insert profiles designed to distribute impact forces are illustrated in FIG. 11 and FIG. 12. This unique hemispherical or mound profile, 3 in FIG. 12, varies in thickness, 5 FIG. 12, to meet the requirements for minimizing the subjected impacted forces. The spacing between the mounds or hemispheres, 3 in FIG. 12, is adjusted to accommodate the radial profile or any profile variation of the incoming object or in this case a baseball or softball so that it never impacts the triangular or radial groove, 4 in FIG. 12, area of the insert. Thus a void is created between the Hemispherical or mound profiles, 3 in FIG. 12, and the triangular or radial grooves, 4 in FIG. 12. The flexibility comes from the triangular or radial grooves, 4 in FIG. 12, lying between the hemispherical or mound profiles, 3 in FIG. 12, generally with less thickness. Holes may be considered as an option for air circulation as illustrated in FIG. 11. A cross sectional view of the flexible plastic insert/pad assembly as illustrated in FIG. 13 exhibits the flexible plastic insert, 7 in FIG. 13, adhered or sewn onto the pad, 6 in FIG. 13. The insert, 7 in FIG. 13, acts as the primary protective layer taking on the initial impact force and then distributing the load which is then accommodated by the pad, 6 in FIG. 13, acting as the secondary protective layer.

It is apparent that modifications and adaptations of the preferred embodiments will occur to those skilled in the art. However, it should be understood that such modifications and adaptations are within the spirit and scope of the present invention as set forth in the following claims.

What is claimed is:

1. An athletic arm protector for distributing impact forces which comprises a flexible plastic insert with a multiple mound profile varying in thickness and spacing between adjacent mounds wherein spacing between the mounds is adapted to be dimensioned so as to be less than a width of an incoming object so that an area between the mounds is not impacted by the incoming object thereby minimizing impact forces of the incoming object, further wherein the area between the mounds comprises a plurality of grooves located on the area between the mounds to provide flexibility of the plastic insert.

2. The athletic arm protector as set forth in claim 1 wherein the mounds further comprise numerous air circulation holes.

3. The athletic arm protector as set forth in claim 1 wherein the arm protector further comprises an upper arm pad that extends down the back side of an upper arm of the athlete to the elbow and a lower pad section that extends down the forearm to the hand of the athlete.

4. The athletic arm protector as set forth in claim 3 wherein the upper arm pad and lower pads are coupled using a clover leaf shaped elbow pad section that provides padding on adjacent sides of an elbow pivotal point.

5. The athletic arm protector as set forth in claim 1 wherein the arm protector further comprises an extended shoulder pad.

6. The athletic arm protector as set forth in claim 1 wherein the flexible plastic insert provides primary padding and protection and further wherein a secondary pad is positioned between the flexible plastic insert and the athlete's body surface.

7. The athletic arm protector as set forth in claim 5 wherein the extended shoulder pad comprises a plurality of flexible plastic inserts assembled to form an expandable sheath pad profile covering the athlete's shoulder so that the inserts expand away from each other when the athlete lifts an arm and the inserts retract when the arm is lowered.

* * * * *